US005596931A

United States Patent [19]

Rössler et al.

[11] Patent Number: 5,596,931

[45] Date of Patent: Jan. 28, 1997

[54] DEVICE AND METHOD FOR DAMPING MECHANICAL VIBRATIONS OF A PRINTING PRESS

[75] Inventors: Georg Rössler, Angelbachtal; Bernhard Wagensommer, Wiesloch, both of Germany

[73] Assignee: Heidelberger Druckmaschinen AG, Heidelberg, Germany

[21] Appl. No.: 522,862

[22] Filed: Sep. 1, 1995

Related U.S. Application Data

[63] Continuation-in-part of Ser. No. 138,333, Oct. 18, 1993, abandoned.

[30] Foreign Application Priority Data

Oct. 16, 1992 [DE] Germany ..... 42 34 928.1

[51] Int. Cl.[6] ..... B41F 1/66

[52] U.S. Cl. ..... 101/484; 101/212; 101/216

[58] Field of Search ..... 101/212, 216, 101/217, 219, 483, 484, 485, 248, 486; 400/144.2

[56] References Cited

U.S. PATENT DOCUMENTS

| | | | |
|---|---|---|---|
| 4,334,790 | 6/1982 | Link et al. | 400/144.2 |
| 5,235,909 | 8/1993 | Gerstenberger | 101/216 |

FOREIGN PATENT DOCUMENTS

| | | |
|---|---|---|
| 0372590 | 6/1990 | European Pat. Off. . |
| 7435840 | 5/1975 | France . |
| 1071967 | 12/1959 | Germany . |
| 1092553 | 11/1960 | Germany . |
| 1117725 | 11/1961 | Germany . |
| 2605476 | 8/1977 | Germany . |
| 3203974 | 8/1983 | Germany . |
| 2902376 | 10/1985 | Germany . |
| 2222279 | 2/1990 | United Kingdom . |

OTHER PUBLICATIONS

ETEP Publ. vol. 2, No. 4, Jul./Aug. (Uhlir), pp. 223–227, "Damping of Electromechanicl Swining . . .".

Papier u. Druck Publ. 37(1988)8, pp. 348–352, "Diagnose-untersuchungen an Rollen–Offsetdruckm . . .".

Elektrie Publ. Berlin 39(1985)5 (Gottschalk), pp. 171–175, "Unterdrückung mechanischer Schwingungen . . .".

*Primary Examiner*—Christopher A. Bennett

*Attorney, Agent, or Firm*—Herbert L. Lerner; Laurence A. Greenberg

[57] ABSTRACT

Device for damping mechanical vibrations of a printing press having rotating parts includes at least one actuating member assigned to the rotating parts of the printing press for applying adjusting forces thereto, and at least one vibration pick-up operatively connected to the actuating member for controlling the actuating member so that the adjusting forces applied by the actuating member damp the mechanical vibrations; and method of damping mechanical vibrations of a printing press.

12 Claims, 5 Drawing Sheets

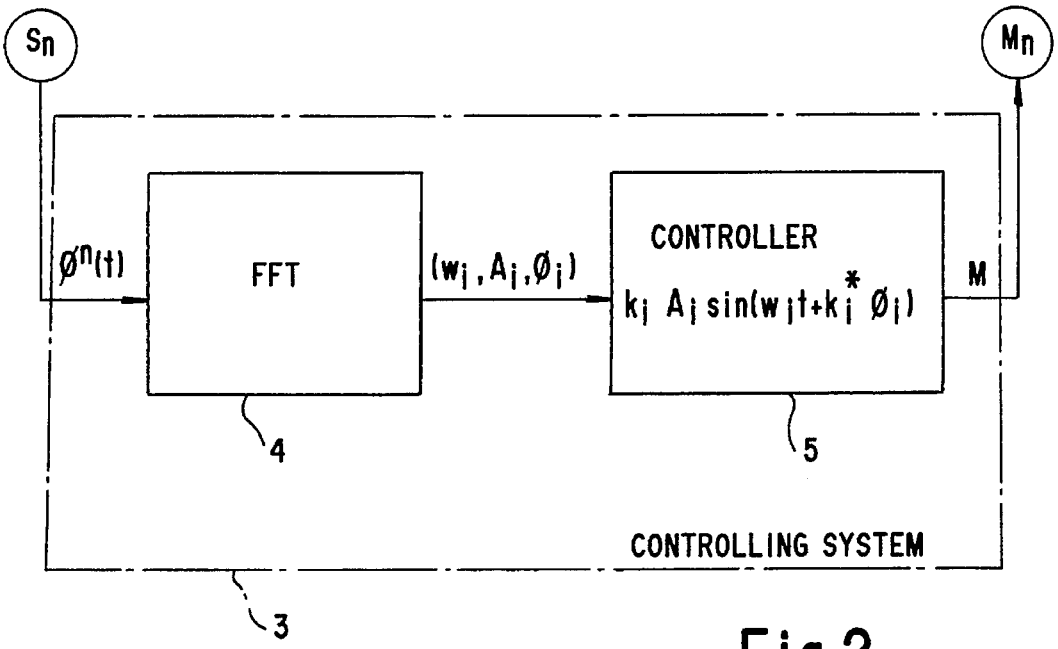
Fig.2
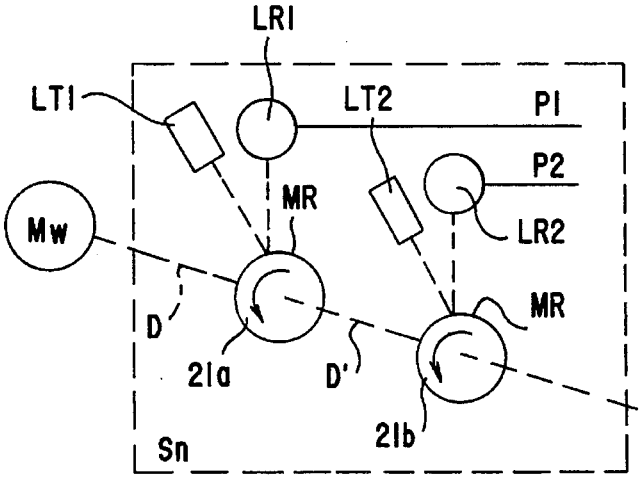
Fig.3a
Fig.3b
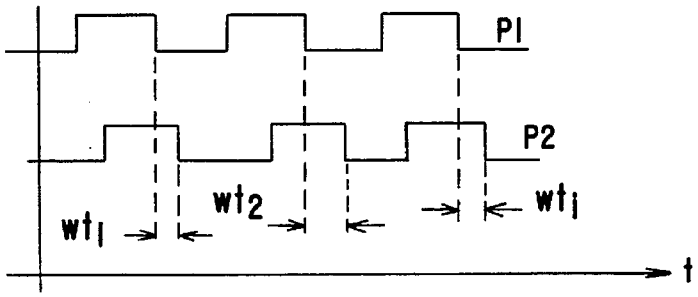

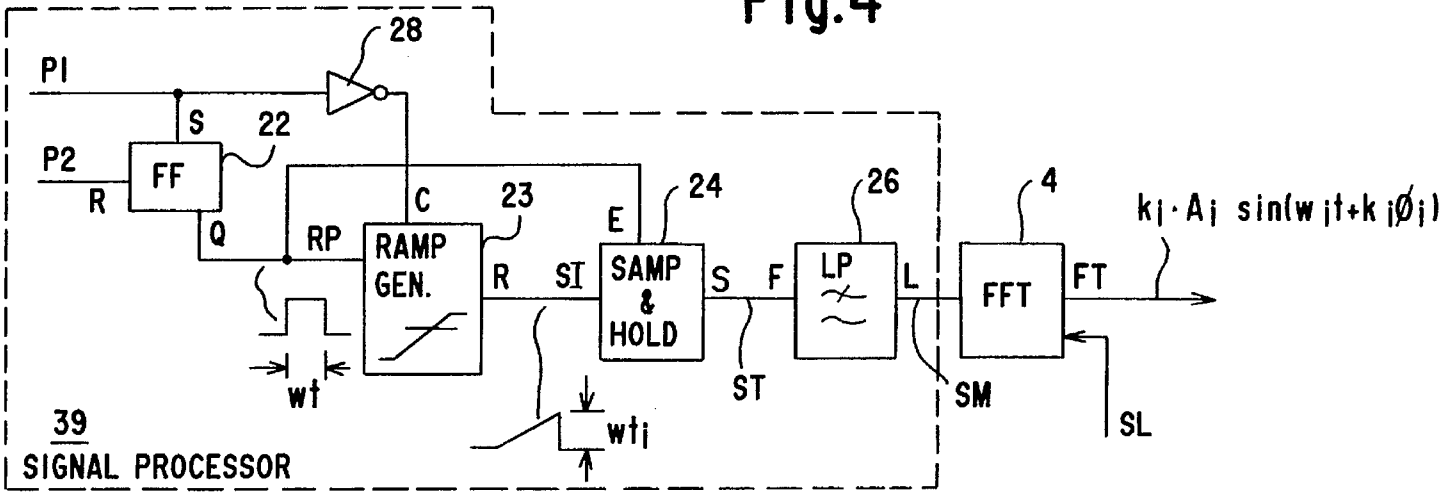
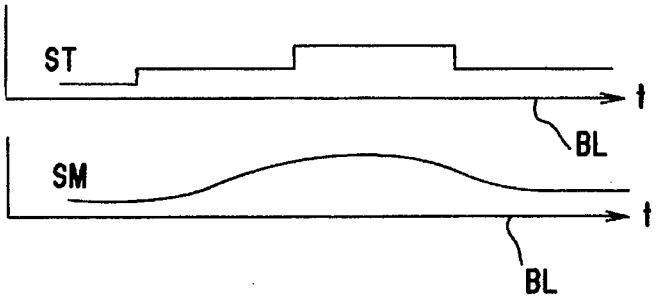
Fig.5a
Fig.5b

DEVICE AND METHOD FOR DAMPING MECHANICAL VIBRATIONS OF A PRINTING PRESS

CROSS-REFERENCE TO RELATED APPLICATION

This application is a continuation-in-part of application Ser. No. 08/138,333, filed Oct. 18, 1993, now abandoned.

BACKGROUND OF THE INVENTION

1. Field of the Invention

The invention relates to a device and method for damping mechanical vibrations of printing presses.

The drive train of a printing press with the parts connected thereto, such as cylinders and rollers, for example, constitutes a system having dynamics which are determined by spring constants, moments of inertia, rotating and oscillating masses, and so forth. The rotating parts of this driven drive train can be excited to vibrations due to the following effects: angle-dependent effects, i.e. synchronous oscillations, recurring over one rotation and effects which do not recur periodically with one rotation, are to be considered as distinct. Recurring load moment deviations, such as are generated, for example, by cam transmissions or by the failure of single or n-revolution gears are to be counted with the angle-dependent, i.e., synchronous, vibrations. Aperiodic or non-cyclical vibrations recurring with one rotation, i.e., asynchronous vibrations, can be produced, for example, by periodic excitations deviating from the rotational frequency. They occur, for example, when belts are used, due to vibrator shock or stroke, or due to errors or failure of half-rotation gears. Aperiodic noise phenomena, such as from ink separating from paper or effects of paper pulling, for example, cause asynchronous vibrations. Furthermore, vibrations can be produced in the system due to parameter deviations which, in comparison with the sheet travel, exhibit a slight change in velocity (for example, oil temperature deviations, which have an effect upon basic friction).

Many angle-synchronous disturbance have a high excitation energy. The periodic vibration shapes over one rotation which result therefrom do not, however, have any noticeable effect upon the printing quality with respect to ghosting in the printed image, because the rotating parts of the printing press always assume the same angular position at the instant of paper transfer or acceptance. Asynchronous disturbances become noticeable, however, in the printing quality. They cause ghosting because the angular position of the rotating parts of the printing press is subject to deviations during sheet transfer. The effect of these disturbances becomes noticeable due to their most often low excitation energy essentially when characteristic or natural frequencies of the printing press are excited, wherein the damping is low. The relatively slow parameter deviations mentioned hereinbefore have no effect upon the ghosting.

It has become known heretofore, for the purpose of reducing mechanical vibrations, to reinforce the side walls of the printing press and/or to install reinforced gears as well as other reinforced components. These measures are expensive, increase the weight of the printing press and do not always produce the desired results.

It is accordingly an object of the invention to provide a device and a method for damping mechanical vibrations of printing presses which improves the printing quality.

SUMMARY OF THE INVENTION

With the foregoing and other objects in view, there is provided, in accordance with one aspect of the invention, a device for damping mechanical vibrations of a printing press having rotating parts, comprising at least one actuating member assigned to the rotating parts of the printing press for applying adjusting forces thereto, and at least one vibration pick-up operatively connected to the actuating member for controlling the actuating member so that the adjusting forces applied by the actuating member damp the mechanical vibrations.

With the device according to the invention, preferably asynchronous disturbances are opposed and subdued. Because these disturbances have considerably low excitation energies, they can be damped by means of relatively low adjustment forces (in comparison with the total drive power). The vibrations are detected, in accordance with the invention, by at least one vibration pick-up. Data determined by the vibration pick-up are evaluated and result in the activation or control of an actuation member which is embodied as an active adjusting member. The adjusting forces applied by the actuating member act in opposition to the forces exciting the vibrations, so that a damping is set or introduced. Ghosting is prevented by the damping of the asynchronous disturbances, so that the printing quality is improved.

In accordance with another feature of the invention, the actuating member is formed as a controllable eddy-current brake. This brake is activated or controlled in accordance with the excitation frequency and thus engages actively in the entire system, thereby eliminating the asynchronous vibrations.

In accordance with a further feature of the invention, the printing press has at least one drive motor, and the function of the actuating member is embodied in the drive motor.

In accordance with an alternative feature of the invention, the printing press has at least one drive motor, and the actuating member is formed by an additional motor.

The torque of the drive motor is able to be influenced or affected, for example, by means of suitable components of the power electronics depending upon or in accordance with the data determined by the vibration pick-up, so that the drive motor per se also performs the function of the actuating member and serves to reduce the vibrations. In this regard, a double function accrues to the drive motor, because it supplies drive power, on the one hand, and serves to damp vibrations, on the other hand. In a corresponding manner, an additional motor can be provided in the drive string or train of the printing press and can be suitably activated or controlled to reduce the vibrations.

In accordance with an added feature of the invention, there is provided a vibration-damping control system having a control circuit to which the vibration pick-up and the actuating member are connected. Due to suitable construction of the control circuit, assurance is always provided that occurring, preferably asynchronous vibrations, will be controlled down to zero, which can result in the achievement of an optimal damping.

In accordance with an additional feature of the invention, the actuating member is controllable by the control system so that only aperiodic or asynchronous vibrations occurring with rotations of the rotating parts of the printing press are damped.

In accordance with yet another feature of the invention, the printing press has a string of drives extending therethrough, and including a plurality of the vibration pick-ups respectively distributed at a plurality of locations along the length of the string of drives.

In accordance with an alternative feature of the invention, the printing press has a string of drives extending therethrough, and including a plurality of the actuating members respectively distributed at a plurality of locations along the length of the string of drives.

In accordance with a combination of both of the alternative features of the invention, pluralities of both the vibration pick-ups and the actuating members are, respectively, distributed at a plurality of locations along the length of the string of drives.

In accordance with a concomitant aspect of the invention, there is provided a method of damping printing quality-reducing mechanical vibrations in a stock-guiding system of a printing press, which comprises picking up vibrations from the stock-guiding system as measured values, processing the measured values to produce adjusting forces, and applying the adjusting forces to the stock-guiding system of the printing press so as to damp the vibrations.

Preferably, aperiodic or asynchronous vibrations occurring with the rotations of the rotating parts of the printing press are detected or picked up and damped.

Other features which are considered as characteristic for the invention are set forth in the appended claims.

Although the invention is illustrated and described herein as embodied in a device and method for damping mechanical vibrations of printing presses, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE DRAWINGS

FIG. 2 is a block and schematic diagram of a control device or system forming part of the invention.

FIG. 3*a* is a block diagram of a vibration detection device connected to the drive train;

FIG. 3*b* is a diagram showing pulse trains generated by the vibration detection device of FIG. 3*a;*

FIG. 4 is a signal processor for processing the pulse trains generated by the vibration detection device, connected with a fast Fourier transform converter;

FIG. 5 shows signal forms as generated by the signal processor of FIG. 4;

DESCRIPTION OF THE PREFERRED EMBODIMENTS

Figure 1:
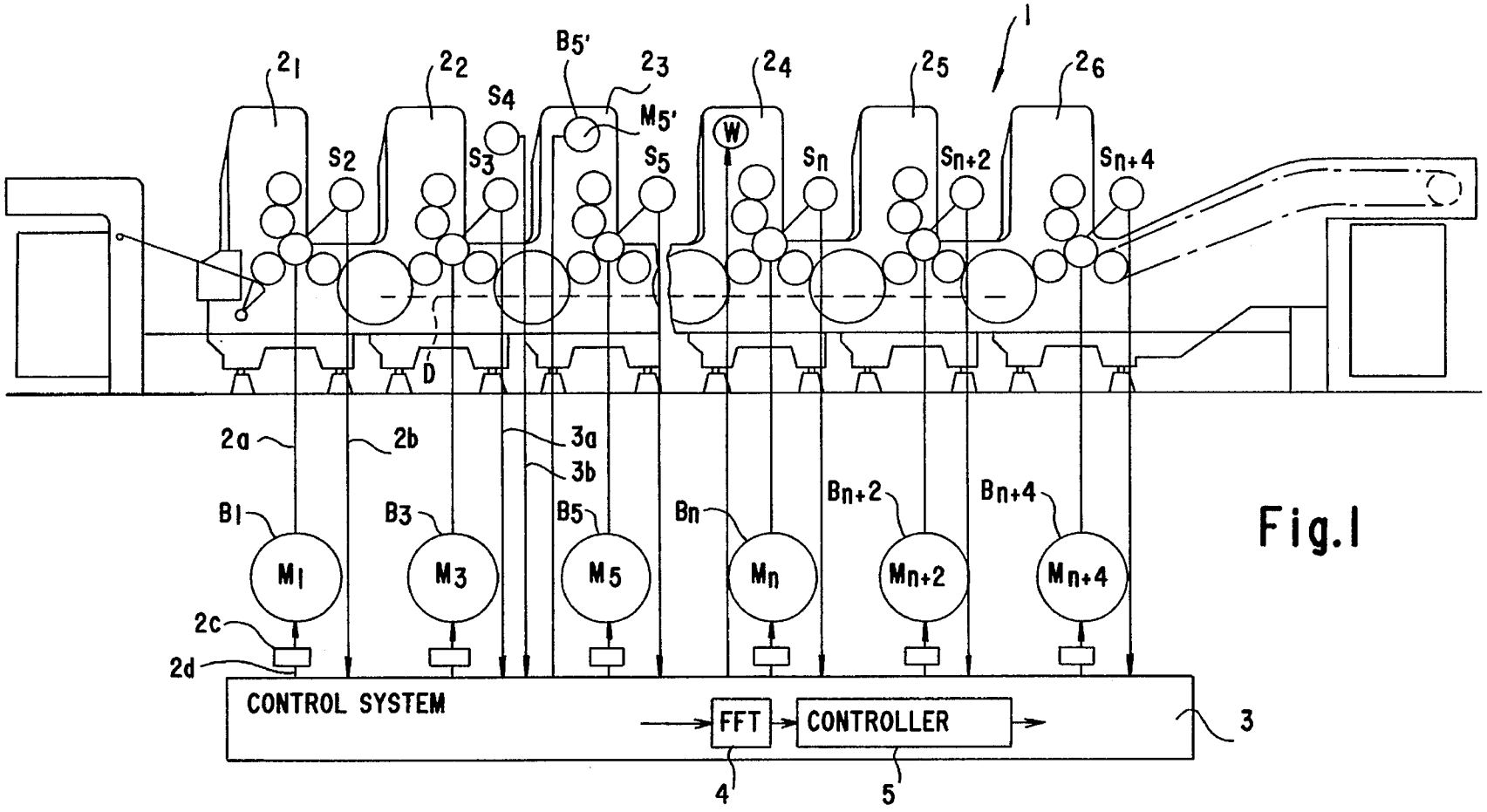
FIG. 1 is a diagrammatic and schematic view of a printing press provided with a device for damping vibrations in accordance with the invention.

Referring now to the drawings and, first, particularly to FIG. 1 thereof, there is shown therein a printing press 1 having a plurality of printing units 2 each identified by a suffix 1–6, namely six printing units $\mathbf{2}_1$–$\mathbf{2}_6$ in the illustrated embodiment. Each printing unit 2 has a plurality of cylinders and rollers, of which, in the interest of clarity, only a few thereof are shown in FIG. 1.

The cylinders and rollers of the printing press 1 form a printing material or stock-guiding system. Each printing unit 2 is driven by a respective drive motor $M_1$, $M_3$, $M_5$, $M_n$, $M_{n+2}$, $M_{n+4}$, such as an electric motor. Respective conventional vibration pick-ups or receivers $S_2$, $S_3$, $S_4$, $S_5$, $S_n$, $S_{n+2}$, $S_{n+4}$ are assigned to the individual printing units 2 and are connected to a control device or system 3.

Each motor $M_n$ has a dedicated motor control $\mathbf{2}_c$ of conventional construction, which controls the power output of the respective motor under control of a respective motor control output $\mathbf{2}_d$ of the control system 3.

Various different embodiments of the invention are actually illustrated in FIG. 1 and are explained hereinafter in greater detail, however, it will be apparent that additional non-illustrated embodiments also fall within the range of the invention.

The printing unit 2, lying farthest to the left-hand side of FIG. 1 has a drive motor M1 which acts upon a drive string, particularly via a conventional gear train, illustrated symbolically as a dashed line D, of the printing press 1. A vibration pick-up S2 which is connected to the control system 3 is assigned to one of the rollers or cylinders of the aforementioned printing unit 2. A conventional operative connection $\mathbf{2}_a$ exists between the printing unit 2 and each of the drive motors $M_1$–$M_{n+4}$.

The device according to the invention of the instant application operates in the following manner:

The vibration pick-up $S_2$ senses, via data lead 2*b*, the occurrence of vibrations in the appertaining printing unit 2, and transmits corresponding data to the control system 3 which performs an evaluation thereof. In particular, aperiodic vibrations are detected or determined and a control value is formed which has a reactive effect upon, i.e., is fed back to the drive motor $M_1$ via the motor control $\mathbf{2}_c$, or directly to the motor $M_n$ as described in more details below. The drive motor $M_1$ thus forms an actuating member $B_1$. Control of the motor $M_1$ is effected in such a manner as not to exert a constant driving torque, but rather, due to the particular control by the control device 3, additional adjusting forces are applied which have an opposing effect upon the asynchronous vibrations, so that altogether a damping of the vibrations is produced.

The second printing unit $\mathbf{2}_2$ from the left-hand side of FIG. 1 has an arrangement corresponding for the most part to that of the aforediscussed printing unit 2, disposed farthest to the left-hand side of the figure, but is different, however, in that more than one vibration pick-up, namely two vibration pick-ups $S_3$ and $S_4$, are provided, which determine the vibrations at different locations of the drive string or train and feed the respective data via control leads 3*a*, 3*b* to the control system 3. A drive motor, namely the motor M3, accordingly, serves simultaneously as an actuating member $B_3$and a vibration damping member.

The third printing unit $2_3$ from the left-hand side of FIG. 1 is provided with yet another embodiment of the vibration-damping device according to the invention. Only one vibration pick-up $S_5$ is provided which is connected to the control system 3. In this embodiment, however, two elements are provided as operating members for applying adjusting forces, namely a drive motor $M_5$ acting as an actuating member $B_5$, and an additional motor $M_{(5)}$, acting as an actuating member $B_{(5)}$, at another location of the drive train. Both of the motors $M_5$ and $M_{(5)}$, are so controlled by the control system 3 that the moments transmitted thereby are set in accordance with the required driving power and also with respect to the damping of the asynchronous vibrations.

The fourth printing unit 24 from the left-hand side of FIG. 1 has an embodiment of the vibration-damping device according to the invention which conforms to the aforedescribed embodiment thereof in the printing unit 2, located farthest to the left-hand side of the figure, with the exception that the control system 3 additionally controls a conventional eddy current brake W to act upon the appertaining drive train of the respective printing unit 2 so as to damp the occurring vibrations.

The manner in which the control system or device 3 functions is described hereinafter in greater detail, with regard to FIG. 2:

The vibration pick-ups $S_n$ are connected to a fast Fourier transform device 4 for fast Fourier transformation (FFT) which is a component of the control system 3. Devices for performing Fourier analysis are well known in technical spectrum analysis, see e.g. Van Nostrand Scientific Encyclopedia pg. 2064–2067. The fast Fourier transform is simply anyone of several fast converging versions of the conventional Fourier transform. Incremental rotary-angle transmitters for the rotary angle $\phi$ of drive train D are suitable as the vibration pick-ups Sn and are coupled with respective driven cylinders of the printing press 1.

FIG. 3*a* shows diagrammatically a set of conventional pulse generators each having a faceted mirror wheel 21*a*, 21*b*, illuminated by respective light transmitters $LT_1$, $LT_2$, which are coupled by a pulsing light beam to respective light receivers LR1, $LR_2$, which generate pulse trains P1, $P_2$. The mirror wheels 21*a*, 21*b* are mechanically coupled by a section of the drive train D.

Furthermore, a controller 5 is provided in the control system 3 and is connected to the FFT device 4. In a practical realization of the invention there may be provided an FFT device 4 for each vibration sensor $S_n$ and a corresponding controller 5 for each FFT device 4 connected to a respective drive motor control 2*c*. Alternatively, a single set of an FFT device 4 and a controller 5 may be shared by a common multiplexing arrangement serving several drive motors $M_n$ and vibration pick-ups $S_n$. The controller 5 has an output connected to the drive motors $M_n$. In the FFT device 4, the rotary angle $\phi^n$ (t) is analyzed or broken down into spectral component of respective frequencies $\omega_i$, vibration amplitude $A_i$ at $\omega_i$ and phase position $\phi_i$ at $\omega_i$ wherein i represents the ordinal number for the harmonic present in the vibration. With the aid of the controller 5, the frequencies critical for the operation of the printing press 1 are selected, for example, the frequencies at which the inherent or natural frequencies of the press are excited. Then, a correction factor $K_i$, respectively, for the i-th harmonic is applied to the amplitude $A_1$. The controller 5 calculates an adjustment value for the torque M of a drive motor $M_n$ from the vibration value $K_i \cdot A_i \cdot \sin(\omega_i t + K_i \omega \phi_i)$, as shown in more detail in connection with FIG. 3*a*, 3*b* and FIG. 4.

In FIG. 3*a* a driving pulse wheel 21*a* is connected to a point of the drive train D, advantageously at a point near the drive shaft of a respective drive motor $M_n$. A driven pulse wheel 21*b* is connected to a point of the drive train D further away from the drive motor, so that the elastic deformation of the intervening section D, of the drive train D is subject to a small angular deflection or pulse angle $\omega_t$, seen in FIG. 3*b* as the phase angle between the two pulse trains P1 and P2 from respective light receivers $LR_1$ and $LR_2$ in FIG. 3*a*. It follows that the deflection angle $\omega_t$ is a function of both time and the moment of torque difference present at the two locations on the drive train to which the respective pulse wheels 21*a* and 21*b* are attached.

It will also be readily appreciated that due to the elasticity in the section D' of the drive train D and the rotating masses angular oscillations in the phase angle $\omega_t$ occur when the driven elements are subject to periodically and aperiodically occurring loads. Such loads occur in printing machines, for example, in driving of sheet grippers and vibrating ink rollers. It is one of the objects of the invention to analyze the phase angle $\omega_t$ in order to identify elements that cause the angular oscillations, and it is a further object to apply the phase angle $\omega_t$ so as to dampen rotary oscillations in the drive train of the printing machine, as will be described in more detail below.

FIG. 4 shows an electronic circuit that processes the pulse trains P1 and P2 so as to generate the harmonics, i.e. spectral components of the function $\omega t$. A flip-flop FF 22 receives the pulses P1 at a set input S, which sets the flip-flop at a trailing edge of each pulse of pulse train P1. A next following trailing edge of a pulse of pulse trains P2 resets the flip-flop. Pulse wheels 2*/a* and 2*/b* are preferably set so that pulse train P2 trails the pulse train P1 by a time distance $\omega_t$, which is always a positive and is a function of the elastic angular deviation between pulse trains P1 and P2, the output Q of FF is set for a duration $\omega t$ which is equal to the instantaneous phase shift between pulse trains P1 and P2. A ramp generator 23 is at its clock input C activated by inverter 28, which starts the ramp, and its input RP is kept active for the duration of a logic high at output Q of flip-flop FF, i.e. during the varying times $\omega_{t1}$, $\omega_{t2}$, $\omega_{ti}$, etc. The ramp generator 23 delivers at its output R a pulse which has an amplitude equal to the varying durations of pulse $\omega_t$ . The ramp generator output has the form of a triangle with an amplitude proportional with the time $\omega_{t1}$, as shown in FIG. 4, and is entered at input SI of a sample and hold circuit 24 of conventional construction. The sample and hold circuit 24 is enabled at input E by the output Q of flip-flop 22, and holds the magnitude of pulse wt for the duration of a complete cycle of pulse train P1, until it is again enabled at the following trailing edge of pulse train P1. The output of the sample and hold circuit becomes a staircase function as shown in FIG. 5, line a. The sample and hold output is connected to an input of a low-pass filter 26 (LP), which smoothes out the discontinuities of the staircase function, to deliver at its output L a smooth signal SM. as shown in FIG. 5*b*. The signal SM is in condition to be delivered to the fast Fourier transform circuit 4 (FFT), which at its output FT delivers the harmonics of the time varying function $\omega_t$, shown as $K_i \cdot A_i \cdot \sin(\omega_i t + K_i \omega \phi_i)$, as described above. The FFT circuit requires for its operation various clock signals CL used for sampling the input signal SM. By proper selection of these clock signals, certain harmonics of the input signal SM can be selected and used to suppress the vibrations of the drive train as described in more detail below.

In one embodiment of the invention the output signal SM from the LP filter 26 is used as a feed-back signal in the drive motor circuit to dampen the oscillations represented by the function SM representing the instantaneous value of the vibration $\omega_t$.

Figure 6:
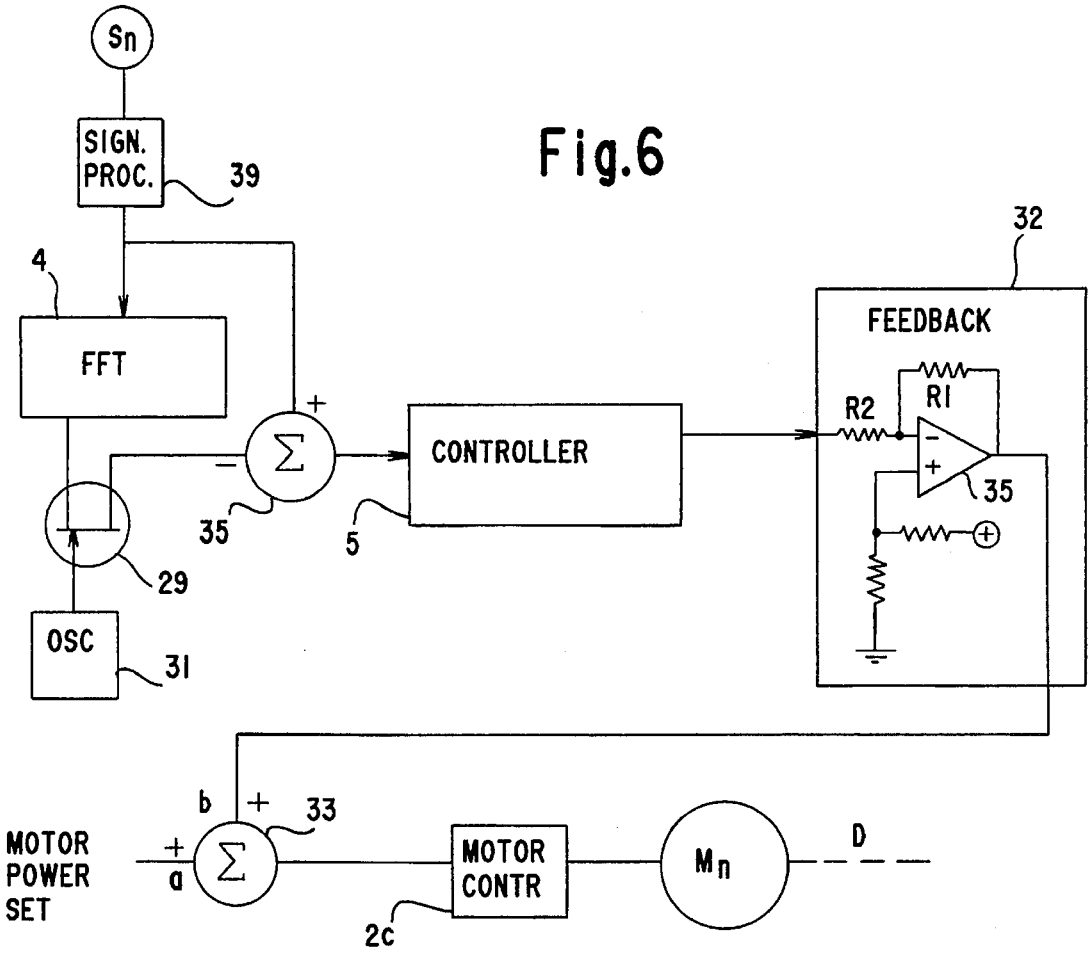
FIG. 6 shows an arrangement wherein the vibrations sensed from the drive trains are processed and inverted and fed back in opposite phase to the drive motor, and having a harmonic vibrations.

In one particular embodiment shown in FIG. 6, certain harmonics may be selected to damp those harmonics found to be especially undesirable.

In FIG. 6 the output of the FFT 4 is connected with an analog gate, shown symbolically as a field-effect transistor 29, having its control gate connected to an oscillator 31 set to a harmonic selection frequency for the particular harmonic or harmonics that are not to be suppressed. The selected harmonic(s) are connected to a minus input of a summing circuit 35, having a minus input connected to the gate 29, and a plus input connected directly to the output of signal processor 39. The output of summing circuit 35 is connected to an input of the controller 5, which has an output connected to an inverting feedback circuit 32, which inverts the signal(s) to be suppressed and calibrates it to the proper level before it is connected to a plus input b of another summing circuit 33. The summing circuit 33 has a plus input for receiving a motor power set control voltage. The output of summing circuit 33 controls via motor control circuit 2*c* the nominal power to be delivered by the motor $M_n$ to the drive train D and the vibration signals(s) to be suppressed. Due to the inversion and calibration performed in feed-back circuit 32, the unwanted signal is suppressed at the input to the motor $M_n$. Calibration is performed by means of resistors R1, R2 in a local feedback loop of OP-amp 35.

Figure 7:
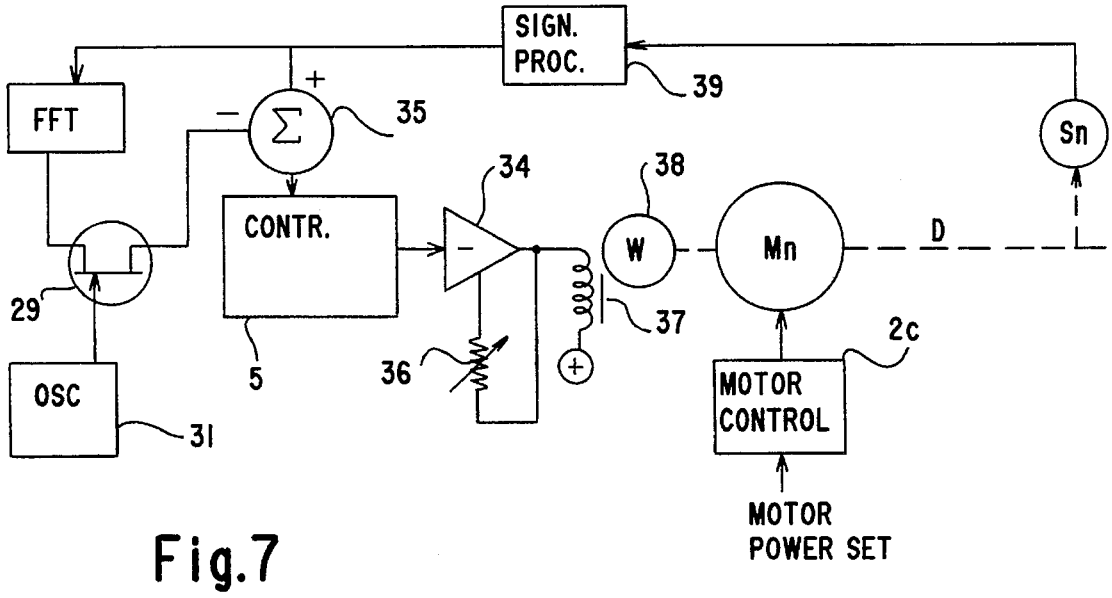
FIG. 7 shows an arrangement wherein the vibrations sensed from the drive train are processed and fed to an eddy current brake coupled to the drive motor and drive train; and having a harmonic selection arrangement for suppressing some or all harmonics with an inhibiting gate and oscillator.

FIG. 7 shows another arrangement briefly described above, wherein the controller 5, receives the signal to be suppressed from a summing circuit 35, which has a plus input receiving the main vibration signal and a minus input receiving the harmonics not to be suppressed, as in FIG. 6. The output of summing circuit 35 is connected to the input of controller 5. The output of controller 5 is connected via an inverting calibrating power amplifier 34 to an eddy current brake W, which is mechanically coupled to the drive motor $M_n$. It follows that the eddy current brake W may be an integral part of the motor $M_n$, or it could be coupled to a suitable point of the drive D. The power amplifier 36 has an external control loop with a control potentiameter 36 for calibrating the amount of braking power to be applied to the eddy current brake W. In FIG. 7 the power output to be delivered by the motor $M_n$ to the drive train D is controlled by a motor power set input to the motor control 2*c*, while the amount of damping to be impressed on the motor by the eddy current brake W is adjusted by potentiometer 36. FIG. 7 shows the eddy current brake as having an electromagnet 37 magnetically coupled to an armature 38 of the eddy current brake in well known manner. The electromagnet is powered by the inverting calibrating amplifier 34. In the arrangement according to FIG. 7 it is contemplated that the electromagnet 37 during normal operation is biased with a certain amount of constant current flowing through the power amplifier 34, so that the eddy current brake W presents a constant drag on the motor $M_n$. In case a sudden loading is applied to the drive train D, causing a vibration that is sensed by the vibration pickup Sn, the vibration signal is processed in signal processor 39, the FFT 4, the control 5, and the inverting calibrating amplifier 34 as described above, and the electromagnet 37 will modulate the drag on the motor $M_n$ in opposite phase of the vibrations, so as to counteract the vibrations. In other words, if a momentary increase in the load on the drive train is encountered, the motor $M_n$ will momentarily encountered increased drag. However, the sensor Sn will detect the increased load as an increased torque in the drive train, and the constant drag on the motor $M_n$ will be momentarily relieved due to momentary reduction in the drag due to the resulting reduction in the current in the electromagnet 37. As a result the motor will be momentarily relieved and apply correspondingly more torque to the drive train, thereby maintaining substantially constant speed of the drive train, assuming that the calibration amplifier 34 is properly calibrated by the potentiometer 36.

It will be readily understood from FIG. 7 that the sensor Sn, signal processing circuit 39, the FFT 4, the controller 5, the calibrating inverting amplifier 34 and the electromagnet 37 with the eddy current brake W together form a stabilizing negative feedback system that will counteract the vibrations and those harmonics of the vibrations, selected by the oscillator 31 and the gating transistor 29.

Figure 8:
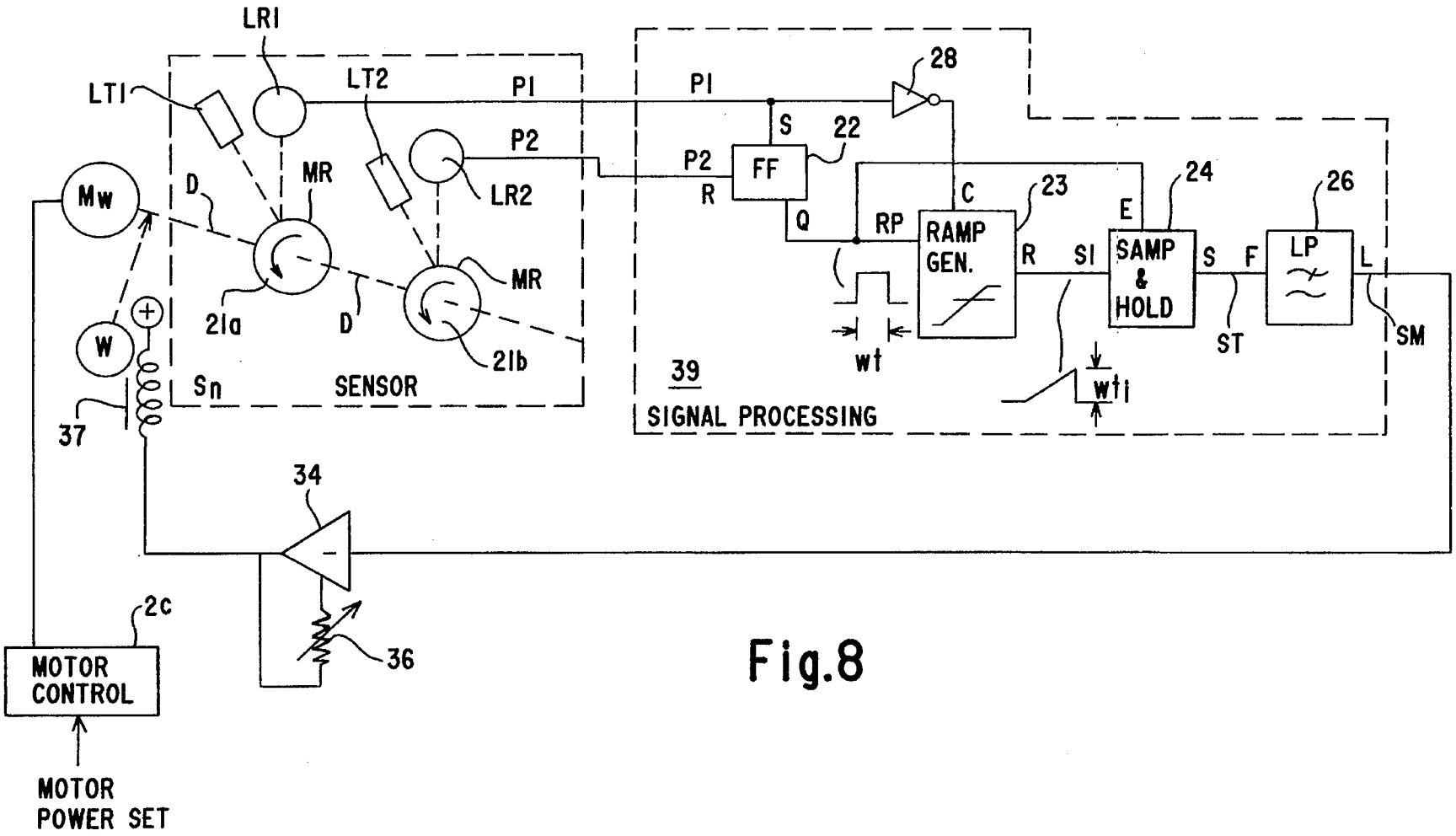
FIG. 8 shows an arrangement for suppressing all vibrations in the drive train, based on an eddy current brake controlled by an inverting calibrating amplifier having an input receiving the drive train vibrations picked up from the drive train and processed.

In cases wherein it is desired to damp all vibrations in the drive train D, it is advantageous to use the signal LM directly as it appears at the output of low pass filter 26 in FIG. 4, without the use of an FFT and harmonic selection circuit 29, 31, 35 as shown in the arrangement in FIG. 8. Again, vibrations can be controlled by acting directly on the drive power applied to the motor or by acting on an eddy current brake coupled to the motor, or to the drive train. FIG. 8 again shows a version of the invention using an eddy current brake W with a biasing electromagnet 37. The arrangement is similar to that shown in FIG. 7, except the signal processing drives the eddy current brake W directly from the output of the low-pass filter 26 via the inverting calibrating amplifier 34. The eddy current brake W may be realized as a secondary drive motor $M_5$ (FIG. 1) being operated in a manner as shown in FIG. 6.

The use of an eddy current brake or a smaller second drive motor has the advantage that the eddy current brake or the smaller motor can be controlled more rapidly than a large drive motor with its larger inertial masses and larger power consumption.

Again in FIG. 8 the eddy current brake may be replaced or supplemented by the motor drive control arrangement 2*c* that acts directly on the drive power to the motor $M_n$ in the manner as shown in FIG. 6.

It is believed to be clear from the foregoing that the aforedescribed embodiments of the vibration-damping device according to the invention may be considered to be only examples which may be installed in a printing press in any desired combination and also, to a broad or wide extent, with a plurality of vibration pick-ups and/or actuating members.

It should be understood that the vibration pickup $S_n$ may have pulse wheels using different sensing methods than optical, i.e. electromagnetic, electrostatic, mechanical and others, as found to be most effective in a given environment.

We claim:

1. In a printing press having rotating parts, a device for damping mechanical vibrations of the rotating parts of the printing press, the improvement comprising at least one actuating member assigned to the rotating parts of the printing press for applying adjusting forces thereto, and at least one vibration pick-up in operative connection with said actuating member for controlling said actuating member so that said adjusting forces applied by said actuating member damp the mechanical vibrations.

2. Device according to claim 1, wherein said actuating member includes as a controllable eddy-current brake.

3. Device according to claim 1, wherein the printing press has at least one drive motor, and wherein said adjusting forces are applied to the drive motor.

4. Device according to claim 1, wherein the printing press has at least one drive motor, and wherein said actuating member includes an additional motor.

5. Device according to claim 1, including a vibration-damping control system having a control circuit with which said vibration pick-up and said actuating member are connected.

6. Device according to claim 5, wherein said actuating member includes connecting arrangements connected with said control system operative for damping only at least one of aperiodic or asynchronous vibrations occurring with rotations of the rotating parts of the printing press.

7. Device according to claim 1, wherein the printing press has a string of drives extending therethrough, and including a plurality of said vibration pick-ups respectively distributed at a plurality of locations along the length of said string of drives.

8. Device according to claim 1, wherein the printing press has a string of drives extending therethrough, and including a plurality of said actuating members respectively distributed at a plurality of locations along the length of said string of drives.

9. Device according to claim 7, and further including a plurality of said actuating members respectively distributed at a plurality of locations along the length of said string of drives.

10. Method of damping printing quality-reducing mechanical vibrations in a stock-guiding system of a printing press having at least one actuating member connected with the stock-guiding system, which comprises picking up vibrations from the stock-guiding system, converting the vibrations to measured values, processing the measured values to produce adjusting forces, and applying the adjusting forces to the actuating member of the printing press so as to damp the vibrations.

11. In a rotary printing press having rotating parts, at least one actuating member coupled to the rotating parts, and at least one vibration pick-up coupled to said rotating parts for picking up vibrations in the rotating parts, a method for damping vibrations i the rotating parts, the method which comprises the steps of:

generating with said pick-up signals representing amplitude and phase of the vibrations;

applying a correction factor to the amplitude of the signals; and applying the signals with the corrected signal amplitude to said actuating member opposingly to said vibrations for damping said vibrations.

12. The method according to claim 11, wherein said actuating member is an electric drive motor.

* * * * *